US009771252B2

(12) United States Patent
Hunter

(10) Patent No.: US 9,771,252 B2
(45) Date of Patent: Sep. 26, 2017

(54) BEVERAGE DISPENSER

(71) Applicant: Streamline Beverage Pty Ltd, Margaret River (AU)

(72) Inventor: Andrew Hunter, Margaret River (AU)

(73) Assignee: Streamline Beverage Pty Ltd, Margaret River, Western Australia (AU)

( * ) Notice: Subject to any disclaimer, the term of this patent is extended or adjusted under 35 U.S.C. 154(b) by 0 days.

(21) Appl. No.: 14/087,792

(22) Filed: Nov. 22, 2013

(65) Prior Publication Data

US 2015/0102063 A1 Apr. 16, 2015

(30) Foreign Application Priority Data

Oct. 15, 2013 (AU) ..... 2013903973

(51) Int. Cl.

| | |
|---|---|
| ***B67D 7/80*** | (2010.01) |
| ***B67D 1/00*** | (2006.01) |
| ***B67D 1/08*** | (2006.01) |

(52) U.S. Cl.

CPC ..... *B67D 1/0009* (2013.01); *B67D 1/0862* (2013.01); *B67D 1/0864* (2013.01); *B67D 1/0867* (2013.01); *B67D 2001/0094* (2013.01); *B67D 2001/0098* (2013.01)

(58) Field of Classification Search

CPC .. B67D 1/0041; B67D 1/0875; B67D 1/1252; B67D 2210/00091

USPC ..... 222/146.1, 130, 131, 129; 62/246, 430

See application file for complete search history.

(56) References Cited

U.S. PATENT DOCUMENTS

| | | | | | |
|---|---|---|---|---|---|
| 41,330 | A | * | 1/1864 | Squarza | 222/157 |
| 581,355 | A | * | 4/1897 | Lapp | 222/130 |
| 587,099 | A | * | 7/1897 | Levi | 137/209 |
| 781,856 | A | * | 2/1905 | Weis | 222/131 |
| 1,613,248 | A | * | 1/1927 | Searing | 222/67 |
| 1,782,944 | A | * | 11/1930 | Stanford et al. | 40/407 |
| 1,893,391 | A | * | 1/1933 | Berry | 222/437 |
| 2,008,121 | A | * | 7/1935 | Armbruster | 222/108 |
| 2,028,098 | A | * | 1/1936 | Zafuta | 222/130 |

(Continued)

FOREIGN PATENT DOCUMENTS

| | | |
|---|---|---|
| AU | 2008207387 | 9/2008 |
| AU | 2011201753 B2 | 5/2011 |

(Continued)

OTHER PUBLICATIONS

Bracton, Beer Towers/Beer Fonts, Sep. 2013, https://web.archive.org/web/20130911213319/http://www.bracton.com/equipement/draught-beer-equipement/beer-towers-fonts, Wayback Machine.

(Continued)

*Primary Examiner* — Patrick M Buechner
*Assistant Examiner* — Michael J Melaragno
(74) *Attorney, Agent, or Firm* — The Webb Law Firm

(57) ABSTRACT

Disclosed is a beverage dispenser including a housing having a beverage storage space capable of storing a volume of a beverage to be dispensed and a heat exchanger subsystem operable to effect the temperature of a beverage stored in or passing through the beverage storage space. The housing is provided with at least one wall through which beverage in the beverage storage space can be visualized. The dispenser includes a coupling enabling the coupling of a valve to facilitate dispensing of beverage from the beverage storage space.

27 Claims, 7 Drawing Sheets

(56) References Cited

U.S. PATENT DOCUMENTS

| | | | | | |
|---|---|---|---|---|---|
| 2,043,856 | A | * | 6/1936 | Knapp | 137/375 |
| 2,072,841 | A | * | 3/1937 | Tracey et al. | 40/407 |
| 2,092,320 | A | * | 9/1937 | Lueck | 62/399 |
| 2,141,221 | A | * | 12/1938 | Panagopoulos | 62/393 |
| 2,167,309 | A | * | 7/1939 | Norton | 62/303 |
| 2,262,043 | A | * | 11/1941 | Perlick | 62/393 |
| 2,394,852 | A | * | 2/1946 | Goddard | 222/94 |
| 2,419,376 | A | * | 4/1947 | Shaw | 62/214 |
| 2,440,406 | A | * | 4/1948 | Kerr | 141/18 |
| 2,506,840 | A | * | 5/1950 | Pique | 62/339 |
| 2,536,404 | A | * | 1/1951 | Walker | 165/132 |
| 2,657,554 | A | * | 11/1953 | Hull | 62/392 |
| 2,699,887 | A | * | 1/1955 | Burden | 222/154 |
| 3,011,681 | A | * | 12/1961 | Kromer | 222/1 |
| 3,012,695 | A | * | 12/1961 | Lerner | 222/129 |
| 3,147,888 | A | * | 9/1964 | Mooney | 222/130 |
| 3,215,312 | A | * | 11/1965 | Guzzi | 222/129.1 |
| 3,224,641 | A | * | 12/1965 | Morgan | 222/129.1 |
| 3,225,965 | A | | 12/1965 | Jacobs et al. | |
| 3,252,633 | A | | 5/1966 | Clarke | |
| 3,263,442 | A | * | 8/1966 | Timmersman | 62/394 |
| 3,346,718 | A | * | 10/1967 | Cooley et al. | 392/401 |
| 3,605,421 | A | * | 9/1971 | Patrick | 62/7 |
| 3,739,842 | A | * | 6/1973 | Whalen | 165/164 |
| 4,061,184 | A | * | 12/1977 | Radcliffe | 165/286 |
| 4,437,319 | A | * | 3/1984 | Iannelli | 62/138 |
| 4,462,220 | A | * | 7/1984 | Iannelli | 62/201 |
| 4,629,096 | A | * | 12/1986 | Schroer et al. | 222/146.6 |
| 4,638,928 | A | * | 1/1987 | Webster | A47J 31/50 126/384.1 |
| 4,728,005 | A | * | 3/1988 | Jacobs et al. | 222/64 |
| 5,004,046 | A | * | 4/1991 | Jones | 165/156 |
| 5,079,927 | A | * | 1/1992 | Rodino et al. | 62/99 |
| 5,112,539 | A | * | 5/1992 | Parnet | 261/128 |
| RE33,943 | E | * | 6/1992 | Arzberger et al. | 62/127 |
| 5,129,552 | A | * | 7/1992 | Painchaud et al. | 222/146.6 |
| 5,370,276 | A | * | 12/1994 | Burrows | 222/146.6 |
| 5,472,121 | A | * | 12/1995 | Silano | B65D 51/1683 220/373 |
| 5,537,838 | A | * | 7/1996 | Mills et al. | 62/400 |
| 5,647,416 | A | * | 7/1997 | Desrosiers et al. | 141/351 |
| 5,743,107 | A | * | 4/1998 | Kyees | 62/390 |
| 5,913,454 | A | * | 6/1999 | McHale | 222/2 |
| 6,105,825 | A | * | 8/2000 | Gomi et al. | 222/146.6 |
| 6,199,386 | B1 | * | 3/2001 | Garrett et al. | 62/51.1 |
| 6,301,918 | B1 | * | 10/2001 | Quartarone et al. | 62/342 |
| 6,681,594 | B1 | | 1/2004 | Nelson | |
| 6,786,255 | B1 | * | 9/2004 | Lee | 141/351 |
| 7,191,614 | B2 | * | 3/2007 | Hess et al. | 62/393 |
| 7,628,023 | B2 | * | 12/2009 | Lucas | 62/98 |
| 7,798,373 | B1 | * | 9/2010 | Wroblewski | A47J 41/0033 222/1 |
| 8,387,826 | B2 | * | 3/2013 | Tsubouchi et al. | 222/23 |
| 8,464,903 | B2 | * | 6/2013 | Baker | 222/1 |
| 2003/0029883 | A1 | | 2/2003 | Newing et al. | |
| 2003/0051488 | A1 | * | 3/2003 | Chiusolo | 62/99 |
| 2003/0146241 | A1 | | 8/2003 | Moothart et al. | |
| 2005/0155982 | A1 | * | 7/2005 | Shannon | B67D 3/0061 222/131 |
| 2006/0080991 | A1 | * | 4/2006 | An et al. | 62/389 |
| 2006/0112719 | A1 | | 6/2006 | Pfeifer et al. | |
| 2006/0207679 | A1 | * | 9/2006 | Ross | 141/94 |
| 2008/0185398 | A1 | * | 8/2008 | Yang | G01F 13/006 222/52 |
| 2009/0057340 | A1 | * | 3/2009 | Moothart | 222/113 |
| 2011/0011569 | A1 | * | 1/2011 | Baker | 165/165 |
| 2012/0055955 | A1 | * | 3/2012 | Fukunaga | B67D 1/0801 222/185.1 |
| 2012/0102989 | A1 | * | 5/2012 | Gov et al. | 62/113 |
| 2012/0213895 | A1 | * | 8/2012 | Rasmussen et al. | 426/106 |
| 2013/0175295 | A1 | | 7/2013 | Koh et al. | |
| 2013/0340453 | A1 | * | 12/2013 | Chan | 62/126 |

FOREIGN PATENT DOCUMENTS

| | | | |
|---|---|---|---|
| CN | 202924711 | U | 5/2013 |
| GB | 381042 | | 9/1932 |
| GB | 2471306 | A | 12/2010 |
| JP | 2003314940 | A | 11/2003 |
| KR | 1020090045485 | A | 5/2009 |
| WO | 0121007 | A1 | 3/2001 |
| WO | 2006103566 | A2 | 10/2006 |

OTHER PUBLICATIONS

Randall the Enamel Animal, www.dogfish.com/print/company/tangents/randall-the-enamel-animal.htm, 2002, Rehobeth Beach, DE, USA.

* cited by examiner

BEVERAGE DISPENSER

TECHNICAL FIELD

The present disclosure relates to a beverage dispenser of a type that may be used for example to dispense carbonated and non-carbonated beverages including but not limited to beer, wine and soft drinks.

BACKGROUND ART

Various types of beverages are dispensed from a bar or counter mounted font. In the art, "font" is often used interchangeably with the terms "tower" or "tower font". One type of font is a form of a metallic tower usually made of stainless steel or cast alloy such as brass. A beverage pipe extends through inside of the tower and has one end fixed to a wall of the tower. A tap or valve is attached to the tower in fluid communication with the fixed end of the beverage pipe. When the beverage pipe is plumbed to a supply of beverage and upon operation of the valve or tap, beverage is dispensed from the font. Temperature control of the beverage may be affected prior to it reaching the tower. Irrespective, it is known to also supply heat exchanger fluid to the inside of the tower to affect heat exchange with the beverage passing through the beverage pipe within the tower. The heat exchange can result in either heating or cooling of the beverage. Though cooling of the beverage is perhaps the most common. When the heat exchanger fluid is for the purpose of cooling the beverage this may have the added effect of causing condensation or indeed a layer of ice to form on the outside of the tower. In relation to the drinking of beer, this is seen as important from a marketing perspective in adding to the theatre of the beer drinking experience.

Dogfish Head Craft Brewery Inc. markets an organoleptic hop transducer module under the brand name Randall the Enamel Animal. The transducer module is a double-chamber filter that is connected to a beer tap and field with flavour enhancing ingredients. This system allows a user to run draught beer through the chambers which may be filled with ingredients such as whole leaf hops, spices, herbs and fruit. The idea is for the alcohol in the beer to transfer the flavour from the ingredients into the beer.

Other devices known as beer infusers are also available which comprise for example a clear glass or plastic tube for holding flavour enhancing material in through which beer passes.

The above references to the background art do not constitute as an admission that the art forms a part of the common general knowledge of a person of ordinary skill in the art. Further, the above references are not intended to limit the application of the beverage dispenser as disclosed herein.

SUMMARY OF THE DISCLOSURE

In broad terms in a first aspect there is disclosed a beverage dispenser that facilitates the dispensing of a beverage in a manner that enables temperature control of the beverage and visualisation of a volume of the beverage to be dispensed prior to or during the act of dispensing. The temperature control of the beverage being dispensed may be achieved by incorporation of a heat exchange circuit or sub-system in the dispenser. The ability to view a volume of the beverage prior to or during dispensing may be achieved by the provision of a transparent wall in the dispenser. In one arrangement, a beverage dispensing space or vessel is formed in the dispenser for holding a volume of the beverage to be dispensed wherein the space is defined at least in part by the transparent wall. The temperature control of the beverage to be dispensed is operable to affect the temperature control of the beverage while the beverage is in the beverage storage space.

In broad terms in a second aspect there is disclosed beverage dispenser that facilitates the visualisation of the beverage to be dispensed as well as any gas breakout at the point of dispensing the beverage. This aspect may also incorporate a vent to expel the gas breakout before the beverage exits the tap. This assists in reducing wastage of the beverage. The vent may be manually or automatically operated. The first and second aspects may be integrated in a beverage dispenser.

In accordance with the first aspect there is disclosed a beverage dispenser comprising:

- a housing having a beverage storage space capable of holding a volume of a beverage to be dispensed, a heat exchanger subsystem being operable to effect the temperature of a beverage held in or passing through the beverage storage space; the housing provided with a wall through which beverage in the beverage storage space can be visualized; and
- a coupling to enable coupling of a valve operable to facilitate dispensing of the beverage from the beverage storage space.

In accordance with the second aspect there is disclosed a beverage dispenser comprising:

- a housing having a beverage storage space capable of storing a volume of a beverage to be dispensed, the housing provided with at least one wall through which beverage in the beverage storage space can be visualized;
- a coupling enabling the coupling of a valve in fluid communication with the beverage storage space operable to facilitate dispensing of the beverage from the beverage storage space; and
- a vent in fluid communication with the beverage storage space and operable to enable bleeding of gas contained in the beverage storage space.

BRIEF DESCRIPTION OF THE DRAWINGS

Notwithstanding any other forms which may fall within the scope of the dispenser as set forth in the Summary, specific embodiments will now be described, by way of example only, with reference to the accompanying drawings in which.

DETAILED DESCRIPTION OF SPECIFIC EMBODIMENTS

Figure 1:
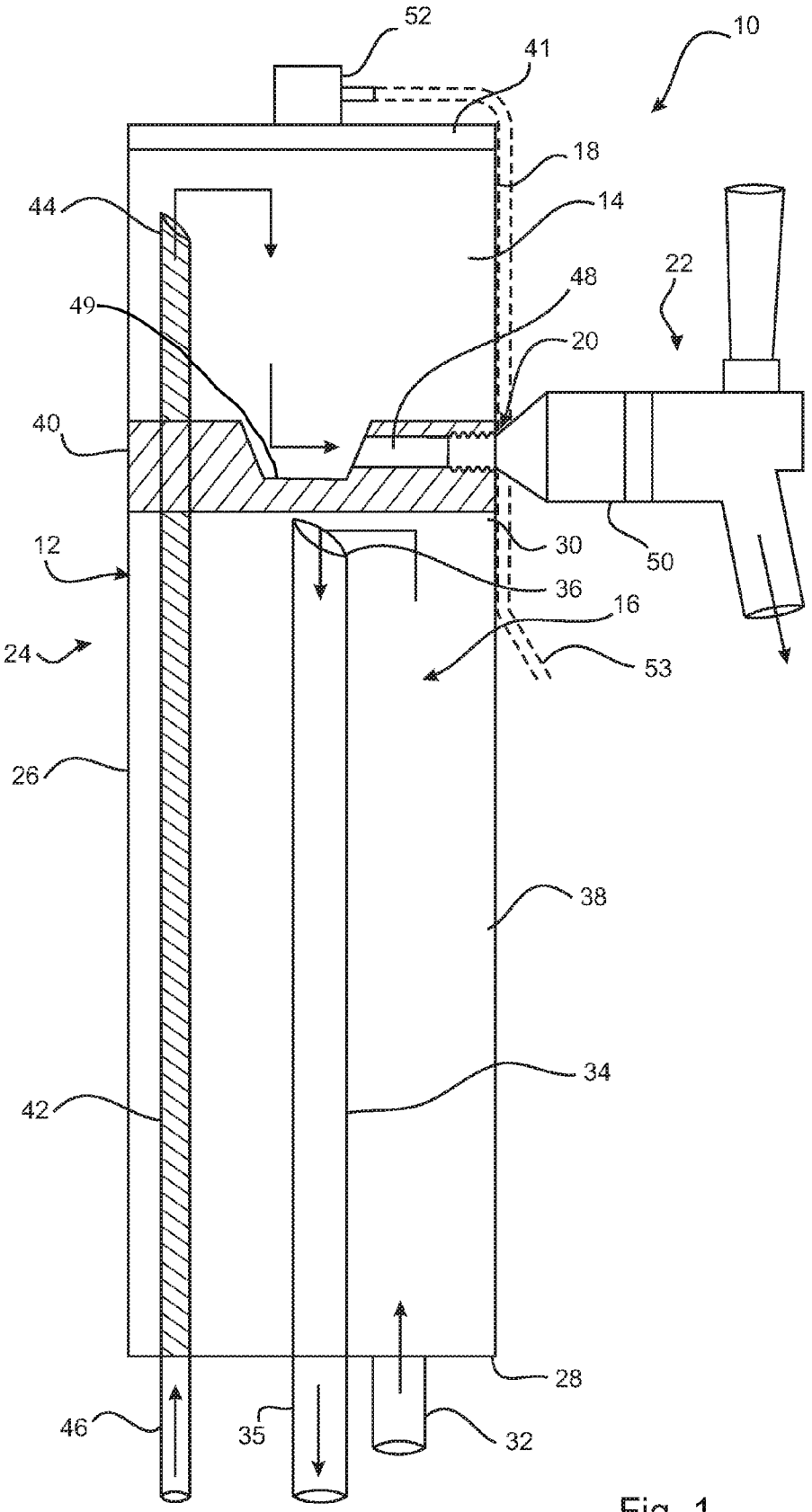
FIG. 1 is a schematic representation of the first embodiment of the beverage dispenser.

FIG. 1 illustrates a first embodiment of a beverage dispenser 10. The beverage dispensed by the dispenser 10 is not material to the structure or operation of the dispenser 10. Any beverage can be dispensed by the dispenser 10. Examples of beverages that may be dispensed include but are not limited to non-carbonated beverages such as water, wine, milk, and fruit juices; and carbonated beverages such as beer and soft drink.

The dispenser 10 comprises a housing 12. Within the housing 12 there is a beverage storage space or vessel 14 capable of storing a volume of a beverage to dispensed. The dispenser 10 also comprises a heat exchanger sub-system 16 that is operable to effect the temperature of a beverage stored in or passing through the beverage storage space 14. The heat exchanger sub-system 16 forms part of an overall heat exchanger system (not shown) used to effect or otherwise control the temperature of the beverage being dispensed by the dispenser 10. Whether the temperature of the dispensed beverage is heated or cooled with respect to ambient temperature is dependent upon the type of beverage being dispensed. The structure of the heat exchanger sub-system 16 is independent of whether the sub-system is used to heat or cool a beverage and may be used for either heating or cooling the beverage.

The housing 12 is provided with at least one wall 18 through which beverage in the beverage storage space 14 can be visualized. The wall may be transparent or at least translucent. A coupling 20 enables the coupling of a valve 22 to the housing 12 to facilitate dispensing of beverage from the beverage storage space 14. The structure and operation of the valve 22 is not essential or material to the working of the dispenser 10. Any third party valve 22 that is able to connect to the coupling 20 to control the dispensing of beverage from the space 14 may be used.

To simplify the further description of this and other embodiments of the beverage dispenser 10, the remainder of the description will be made with reference to the beverage being beer and the heat exchanger sub-system operable to effect cooling of the beer. However it is to be reiterated that this is only for the purpose of aiding in the description of the preferred embodiments and is not intended to limit the use of the described embodiments of the beverage dispenser 10.

In the present embodiment, the housing 12 is in the general form of a tower 24 having a lower cylindrical portion 26. One end of the cylindrical portion 26 forms a base 28. When the dispenser 10 is mounted on a bar or counter, the base 28 is adjacent an upper surface of the bar or counter. The beverage storage space 14 is disposed adjacent an opposite end 30 of the cylindrical portion 26. Thus the cylindrical portion 26 and the beverage storage space 14 together form the housing 12/tower 24. The cylindrical portion 26 may be made from stainless steel while the wall 18 of the beverage storage space 14 is made from transparent or translucent glass or plastics material. Moreover, the wall 18 may be in the configuration of a tube having substantially the same outer diameter as that of the cylindrical portion 26.

The heat exchanger sub-system 16 comprises a heat exchanger fluid inlet pipe coupling 32 fixed to the base 28. Heat exchanger fluid from a heat exchanger system is able to flow into the housing 12 via a pipe or conduit (not shown) attached to the inlet pipe coupling 32. The heat exchanger sub-system 16 also includes a heat exchanger outlet conduit 34 which enables heat exchanger fluid to subsequently flow out of the housing 10. The conduit 34 has an open upper end 36 disposed adjacent the end 30 and the beverage storage space 14. A heat exchanger fluid outlet pipe coupling 35 is fixed to the base 28 and forms part of or at least is in fluid communication with the conduit 34. The coupling is arranged to enable coupling with a greater heat exchanger system. The heat exchanger sub-system 16 is completed by a tank 38 which is constituted by the cylindrical portion 26 of the housing 12.

When the system 10 is in use dispensing beer, inlet and outlet pipes (not shown) from a cool room are coupled with the inlet and outlet pipe couplings 32 and 35. Coolant such as glycol mixed with water, or water mixed with freezing inhibitor, or water only, flows into and floods the tank 38 flowing out from the open end 36 back down the conduit 34 returning to the cool room. This enables the circulation of glycol (or other heat exchanger fluid) through the housing 12.

The tank 38 and the beverage storage space 14 are separated by a wall 40. The wall 40 may be made as either: a part of the beverage storage space/vessel 14; a part of the cylindrical portion 26/tank 38; or a separate component coupled between the cylindrical portion 26 and the beverage storage space/vessel 14. Which of the above options is utilised to incorporate the wall 40 into this embodiment of the beverage dispenser 10 not critical to the overall functionality of the dispenser 10.

In this and other embodiments the beverage storage space 14 may be considered to be a beverage storage vessel (hence the previous dual references to "space or vessel 14" and "space/vessel 14") comprising the wall 18, the wall 40 and a lid 41 located at an end to the wall 18 opposite the wall 40. One or both of the wall 40 and lid 41 may be detachably coupled to the wall 18. This enables a user to dismantle the space/vessel 14 for the purpose of cleaning and maintenance. Further the space/vessel 14 can itself be demountable coupled to the remainder of the tank portion of the housing.

The wall 40 acts to fluidically separate the tank 38 from the beverage storage space 14. This prevents the heat exchanger fluid that flows through the tank 38 from directly contacting or mixing with beverage held within the space 14. It may also provide a coupling point for the valve 22. In some but not necessarily all embodiments the wall 40 also acts as thermal conductor for the purposes of heat exchange between the heat exchanger fluid and the beverage.

A beverage conduit 42 extends through the tank 38, the wall 40 and into the beverage storage space 14. The conduit 42 has an upper open end 44 enabling beverage such as beer to flow into the space 14. A lower end 46 of the conduit 42 passes through the base 28 and is arranged to enable coupling to a beer supply line.

To enable beer within the space 14 to be dispensed from the dispenser 10, a dispensing channel 48 is formed in the wall 40 and extends to, the outlet 20. The channel 48 opens onto a recessed surface 49 of the common wall 40, and the recessed surface 49 faces the beverage storage space 14. In this embodiment the outlet 20 is in the form of a screw thread enabling the screw coupling of an adapter 50 to the housing 12/common wall 40. The valve 22 is subsequently attached to the adapter 50.

In this embodiment the dispenser 10 is also provided with a vent 52 provided on the lid 41 at an upper most end of the beverage storage space 14. The vent 52 can be selectively operated (either manually or automatically) to vent gases that may break out of beer flowing into or held in the beverage storage space 14. Optionally a pipe 53 (shown in phantom line in FIG. 1) can be coupled to the vent 52. The pipe 53 extends down a portion of the tower 14 on a side of the valve 22. A free end of the pipe can bend or at least can be bendable away from the tower 14 below valve 22. As discussed below this enables gas bled from the vent (either by itself or as part of a foam/fob) to be directed into a drinking vessel holding a volume of beverage dispensed from the beverage dispenser.

When the pipe 53 is provided and the vent 52 operated the gas together with some beverage will be dispensed from the pipe 53. It will be recognised that the mixing of gas and beverage will usually (and for beer will) form a foam, common known in the industry as "fob". This foam/fob may be added to the upper surface of a glass of beverage previously discharged from the valve 22. Thus for beer this may add to head or create a head. Alternately if only gas is dispensed and free end of the pipe 53 is located below the surface of the beverage, then the vent 52 operated, the gas will create foam or add further foam to the beverage. In this way the vent 52 may be considered as constituting or acting as a foamer.

By virtue of the arrangement of the heat exchanger subsystem 16, heat exchanger fluid such as glycol mixed with water will directly contact the wall 40. Thus the beverage storage space 14 is disposed to enable direct contact with the heat exchanger fluid circulating through the sub-system 16. Transfer between the heat exchanger fluid and beer within the space 14 is provided via conduction across the wall 40. To facilitate this transfer of heat, the wall 40 may typically be made from a metal such as stainless steel. Additionally, as a substantial length of the conduit 42 passes through the tank 38, heat exchange is also facilitated while beer is flowing through the portion of the conduit 42 disposed within the tank 38. As will be appreciated by those skilled in the art, the degree of heat exchange may be increased by increasing the length of the portion of the conduit 42 within the tank 38. This can be achieved for example by forming this portion of the conduit as a coil for example circulating about the conduit 34.

In use, the dispenser 10 will be mounted on a counter or bar. The couplings 32 and 35 will be coupled to inlet and outlet pipes respectively of a greater heat exchanger system. Lower end 46 of a conduit 42 will be coupled to a beer supply line. The heat exchanger sub-system 16 enables glycol to be circulated through the housing 12 and in particular the tank 38. Beer flowing into the space 14 is cooled by a combination of cooling while flowing through the portion of conduit 42 disposed within the tank 38; and also by virtue of heat exchange across the wall 40 while held within the space 14. The space 14 may hold for example a volume of beer corresponding to two or three regular servings. It is envisaged that when beer is not being dispensed by the dispenser 10, the space 14 is substantially filled with beer. As beer is being dispensed more beer will enter the space 14 via the conduit 42. Due to the heat exchange occurring within the dispenser 10, condensation is most likely to occur on the housing 12 on both of the cylindrical portion 26 and the wall 18.

A person serving beer from the dispenser 10 will also be able to visualize gas breakout within the beer at the point of dispensing and thus before the beer exits the system 10. This will be apparent by the appearance of an "air gap" within the space 14 and above the surface level of the beer; and/or by excessive froth in the space 14. In this event, the vent 52 can be operated (either manually or automatically) to bleed the gas from the space 14 prior to dispensing beer via the valve 22. This assists in reducing wastage of beer. By way of background, gas breakout is a relatively common problem with draft beverage systems. Gas breakout can be caused by worn seals and O-rings, faulty equipment, incorrect equipment installation, incorrect dispense pressures or incorrect dispense temperatures. This allows gas propellant to "break out" of the beer prior to being dispensed. This results in foam/heady beer and excessive wastage. This problem can occur anywhere within a draft system. Thus while the provision of the wall 18 in the space 14 is primarily to enable drinkers to visualize the beer prior to and during it being dispensed, it further enables a level of fault detection within a draft system to which the dispenser 10 is coupled. A user of the system 10 on the visualization of the breakout within the space 14 may be prompted into carrying out investigations as to the source and location of the gas breakout. Alternately as discussed above the vent 52 together with the pipe 53 may be used as a foamer.

Figure 2:
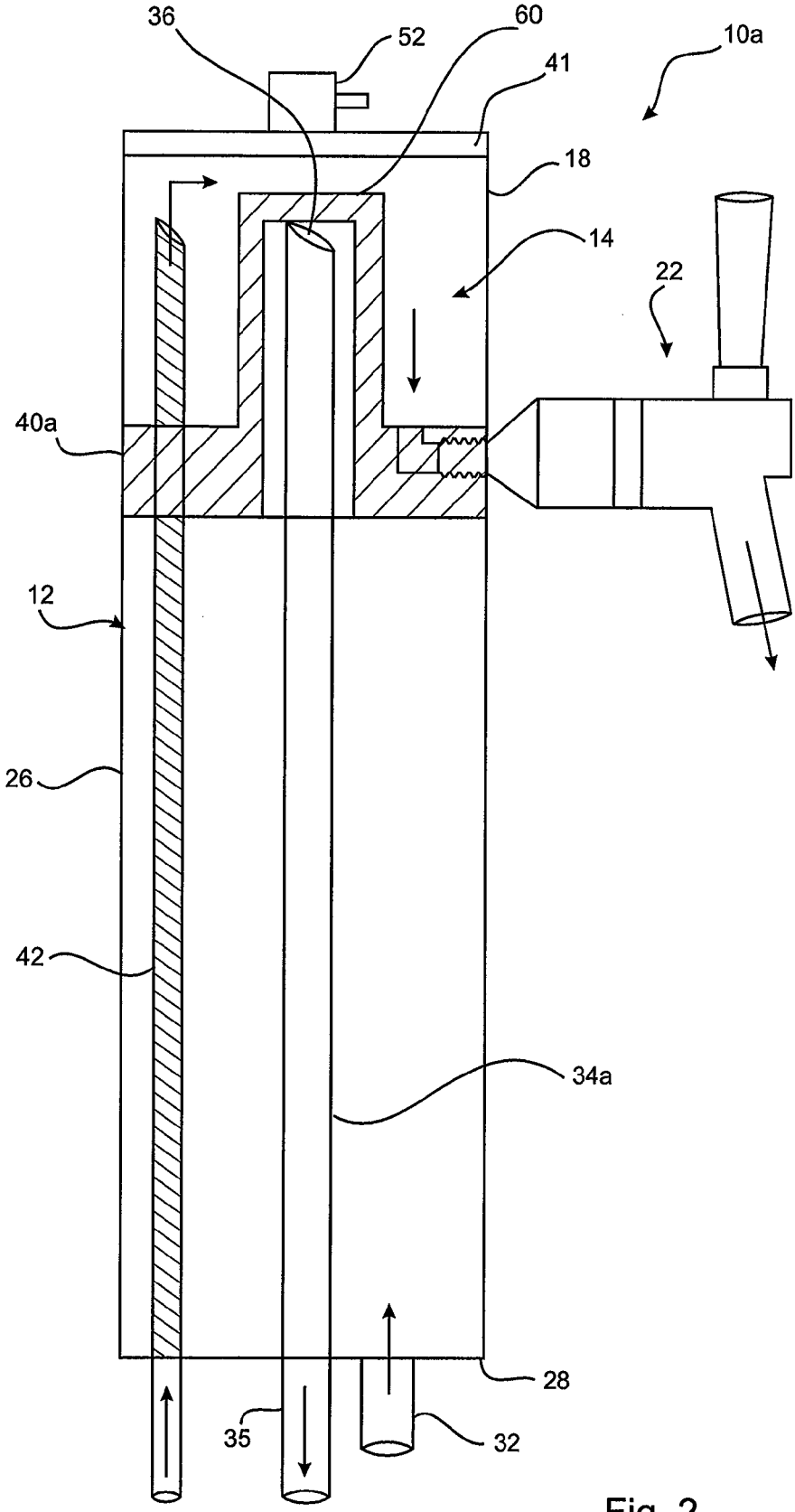
FIG. 2 is a schematic representation of a second embodiment of the dispenser.

FIG. 2 illustrates a second embodiment of the beverage dispenser. This embodiment is denoted by the reference number 10*a*. All features of the beverage dispenser 10*a* that are identical to those of the dispenser 10 are designated with the same reference numbers. The features of the beverage dispenser 10*a* that are different or modified from the system 10 are denoted with the same reference number but with the addition of the suffix "a".

The beverage dispenser 10*a* differs from the beverage dispenser 10 only in the configuration of wall 40*a* and length of the conduit 34*a*. In the dispenser 10*a*, the wall 40*a* is formed with a central closed end tubular portion 60 that extends into the beverage storage space 14. The conduit 34*a* extends into the portion 60. The open upper end 36 of the conduit 34*a* lies immediately adjacent an upper wall of the portion 60. Forming the wall 40*a* in this configuration provides greater surface area of the wall 40*a* within the space 14. This in turn enables a high degree of heat exchange by way of thermal conduction through the wall 40*a*.

Figure 3:
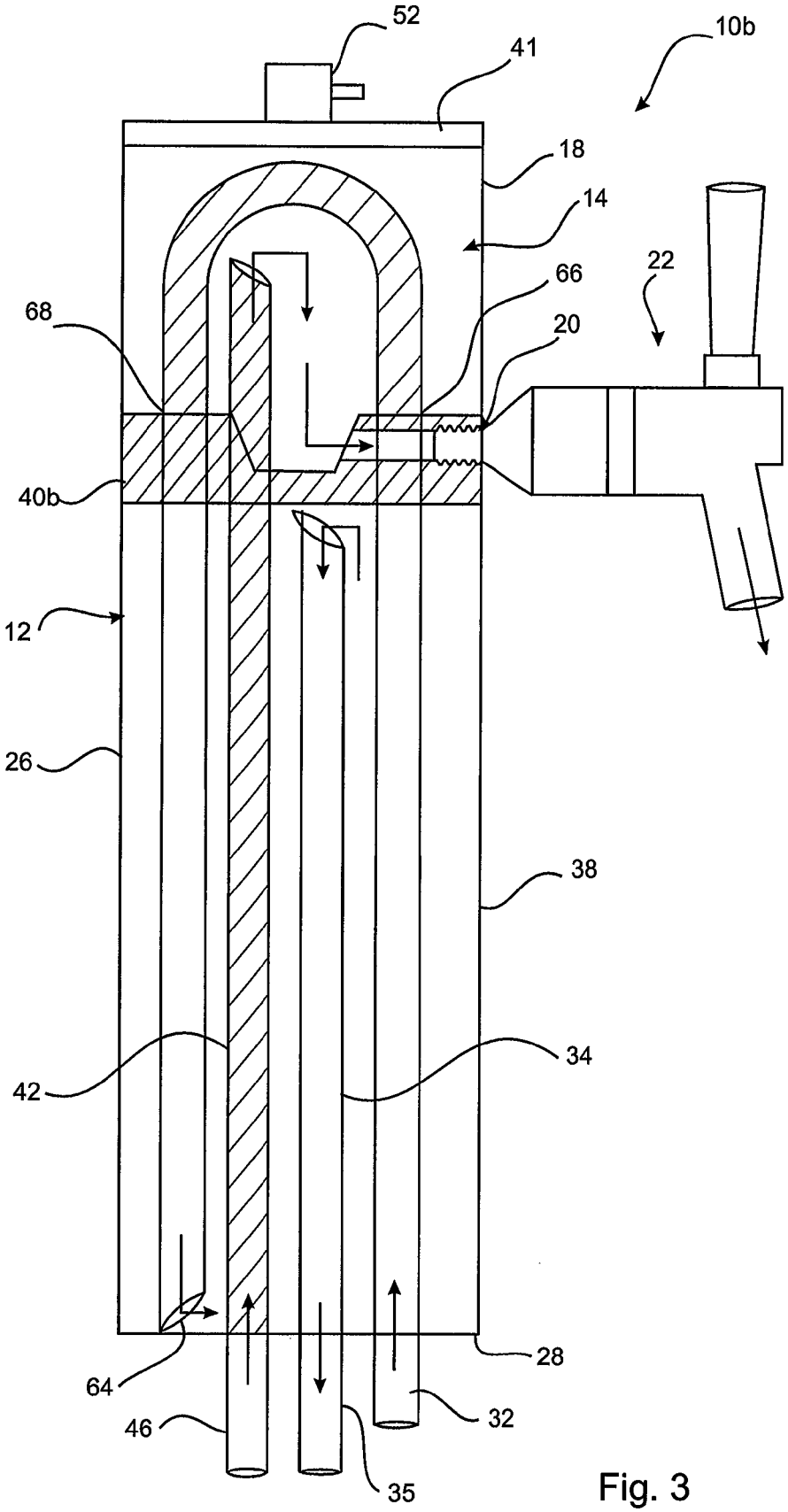
FIG. 3 is a schematic representation of a third embodiment of the beverage dispenser.

FIG. 3 illustrates a further embodiment of the beverage dispenser designated as 10*b*. All features of the dispenser 10*b* that are the same as the dispenser 10 are designated with the same reference numbers. Features which are similar to or modified with respect to the beverage dispenser 10 are designated with the same reference number but with the addition of a suffix "b".

The beverage dispenser 10*b* differs from the beverage dispenser 10 by way of a modified wall 40*b* and the addition of a heat exchanger conduit 62. The conduit 62 is coupled or otherwise in fluid communication with the inlet pipe coupling 32. Conduit 62 extends upwardly through the housing 12 through the cylindrical portion 26 into the beverage storage space 14 and back down the cylindrical portion 26. A discharge end 64 of the conduit 62 is located adjacent an inside surface of the base 28. The wall 40*b* is formed with two holes 66 and 68 enabling the conduit 62 to form a continuous flow path from the inlet coupling 32 through the tank 38 into the space 14 and back into the tank 38. This flow path is fluidically isolated from beer held within the space 14. Glycol coolant discharges from the end 64 and floods the tank 38 circulating back to a cool room through the conduit 34. The purpose and effect of the portion of the conduit 62 that extends through the space 14 is the same as that of the tubular portion 60 in the dispenser 10*a*, namely to provide to greater surface area for transfer via thermal conduction.

Figure 4:
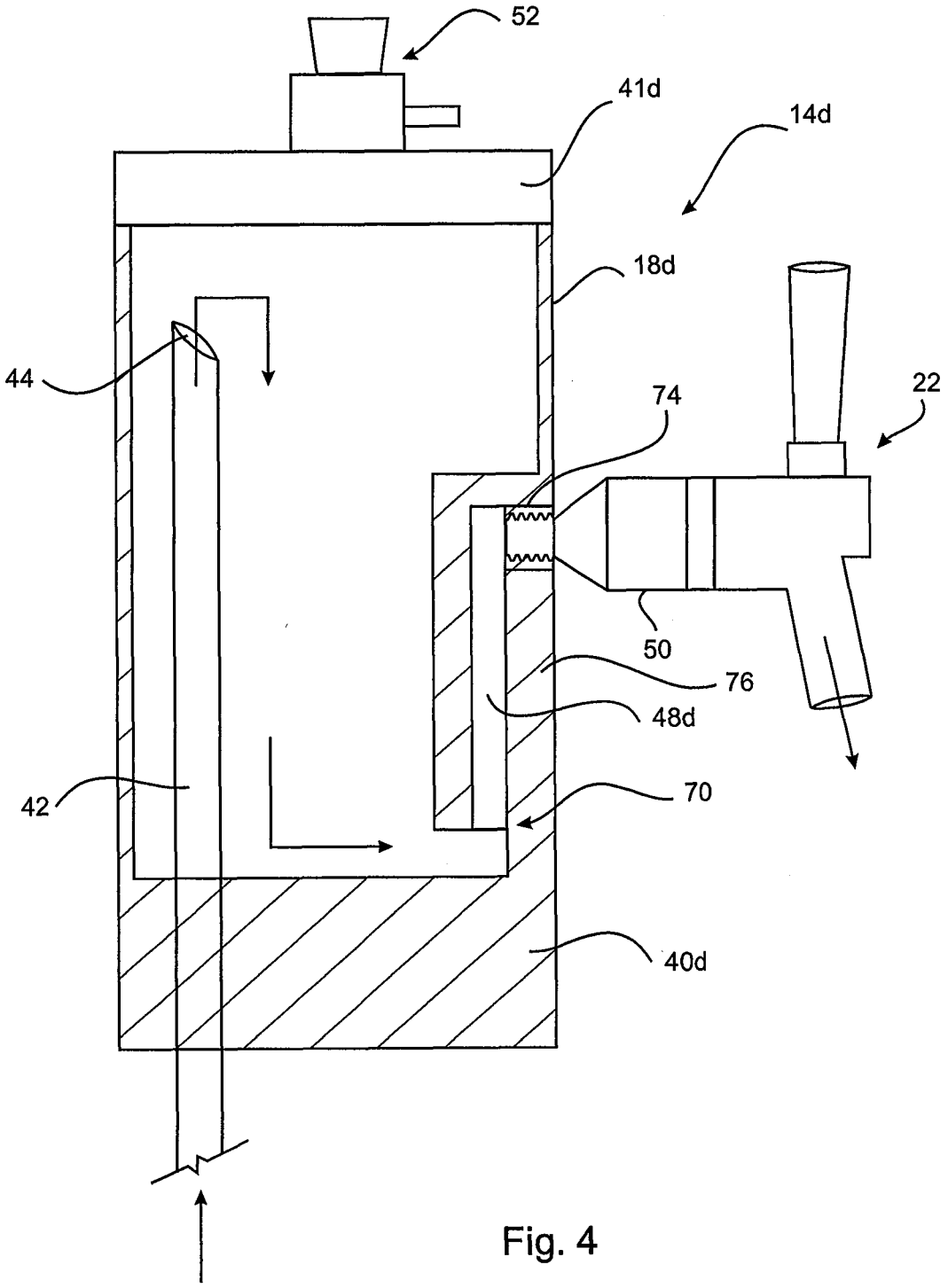
FIG. 4 is a schematic representation of a fourth embodiment of the beverage dispenser.

FIG. 4 illustrates a beverage storage space 14*d* that may be incorporated in an alternate embodiment of the beverage dispenser. The beverage storage space 14*d* is composed of a one piece receptacle 70 and a lid 41*d*. The receptacle 70 incorporates a bottom wall 40*d* and wall 18*d* which are formed together as a single piece. The receptacle 70 may for example be made from a transparent or translucent plastics material or glass. An internally threaded ring 74 may be embedded in the receptacle 70 to facilitate coupling with an adapter 50. The lid 41*d* may be screw coupled or clamped onto an upper end of the wall 18*b*. In this embodiment a channel 48*d* is formed as a blind hole within a thickened portion 76 of the wall 18*d*. The beverage storage space 14 may be coupled to the end 30 the cylindrical portion 26 of housing 12 shown in FIG. 1.

The above described embodiments of the beverage dispenser are formed with a single beverage storage space 14. However alternate embodiments are possible having multiple beverage storage spaces.

Figure 5:
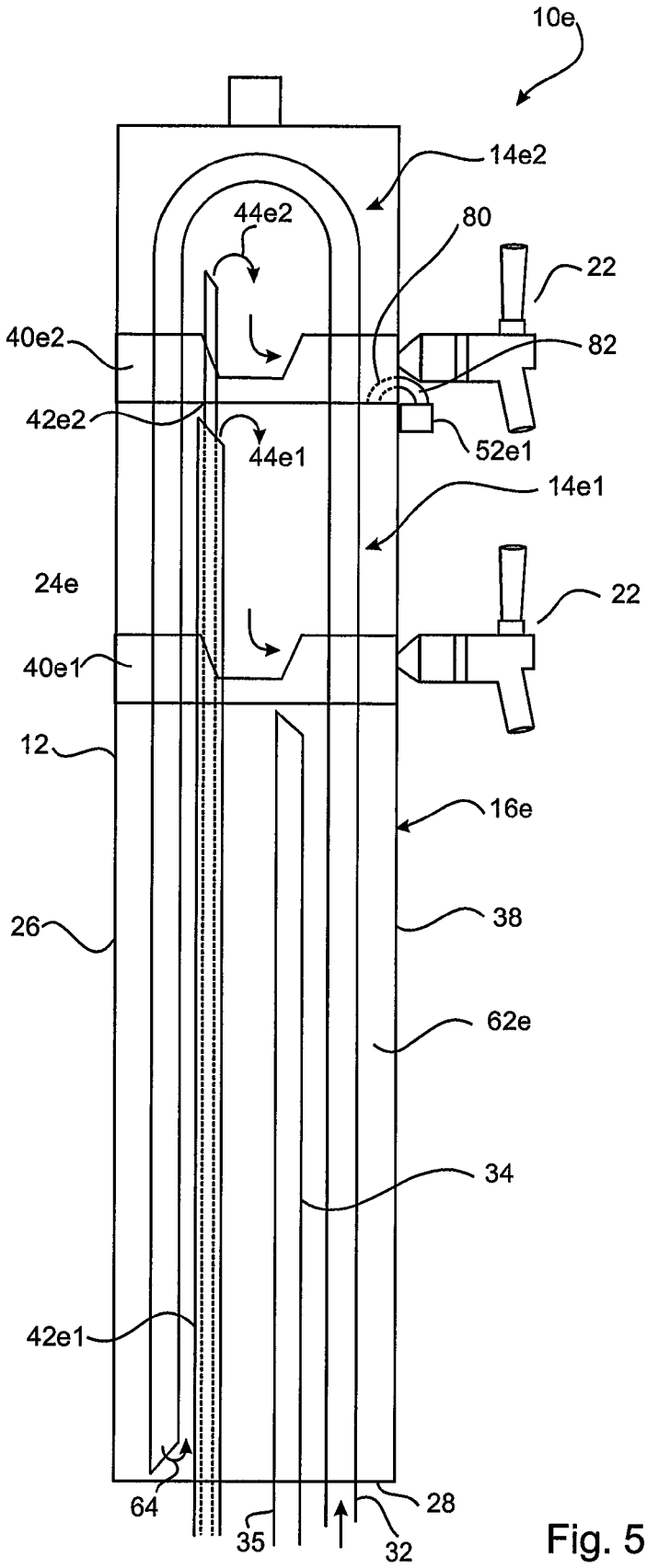
FIG. 5 is a schematic representation of a fifth embodiment of the beverage dispenser.

FIG. 5 illustrates a beverage dispenser 10*e* having two beverage storage spaces/vessels 14*e*1 and 14*e*2. This enables the visualisation and dispensing of two different types or flavours of beverage (for example beer) from the one dispenser. The dispenser 10*e* is based on the dispenser 10*b* shown in FIG. 3. The beverage dispenser 10*e* comprises a housing 12 having a cylindrical portion 26 with the beverage storage space 14*e*1 immediately above the cylindrical portion 26 and the second beverage storage space 14*e*2 immediately adjacent the space 14*e*1. Together the portion 26 and spaces 14*e*1 and 14*e*2 form a tower 24*e* of a substantially constant outer diameter.

The heat exchanger sub-system 16*e* includes a conduit 62*e* that extends from the inlet pipe coupling 32 upwardly through the tank 38, through the space 14*e*1, into and through the space 14*e*2, looping back down to return again via the space 14*e*1 and back into the tank 38. Conduit 62*e* has an open discharge end 64 near the base 28 to enable flooding of the tank 38 with glycol. The glycol returns to a cool room via the conduit 34 and coupling 35. The passage of the conduit 62*e* through the space 14*e*2 provides additional cooling to beer within the space 14*e*2. This cooling is provided by thermal conduction between beer within the space 14*e*2 and glycol flowing through the conduit 62*e*.

In order to enable beer to flow into the spaces 14*e*1 and 14*e*2 two beverage conduits 42*e*1 and 42*e*2 are provided. The conduit 42*e*2 extends through the conduit 42*e*1. The conduit 42*e*1 has an outlet opening 44*e*1 disposed within the space 14*e*1. The conduit 42*e*2 has an outlet opening 44*e*2 disposed within the space 14*e*2. Thus different beers may be provided into the spaces 14*e*1 and 14*e*2 by connecting the conduits 42*e*1 and 42*e*2 to separate beer supplies.

Each of the beverage storage spaces 14*e*1 and 14*e*2 is demarcated by a respective wall 40*e*1 and 40*e*2. Wall 40*e*1 is of the same configuration as the wall 40*b* shown in FIG. 3. The wall 40*e*2 has substantially the same configuration as the wall 40*b* the only difference being the addition of a passage 80 to enable coupling to a vent 52*e*1. The passage 80 turns to approximately 90° and has one end that opens onto a lower surface of the wall 40*e*2 and into the space 14*e*1. An opposite end of the passage 80 opens onto a circumferential surface of the wall 40*e*2 to enable coupling to a pipe 82 and subsequently to the vent 52*e*1. In this way gas which may have separated from beer entering the space 14*e*1 through the pipe 42*e*1 can be vented via the vent 52*e*1.

Figure 6:
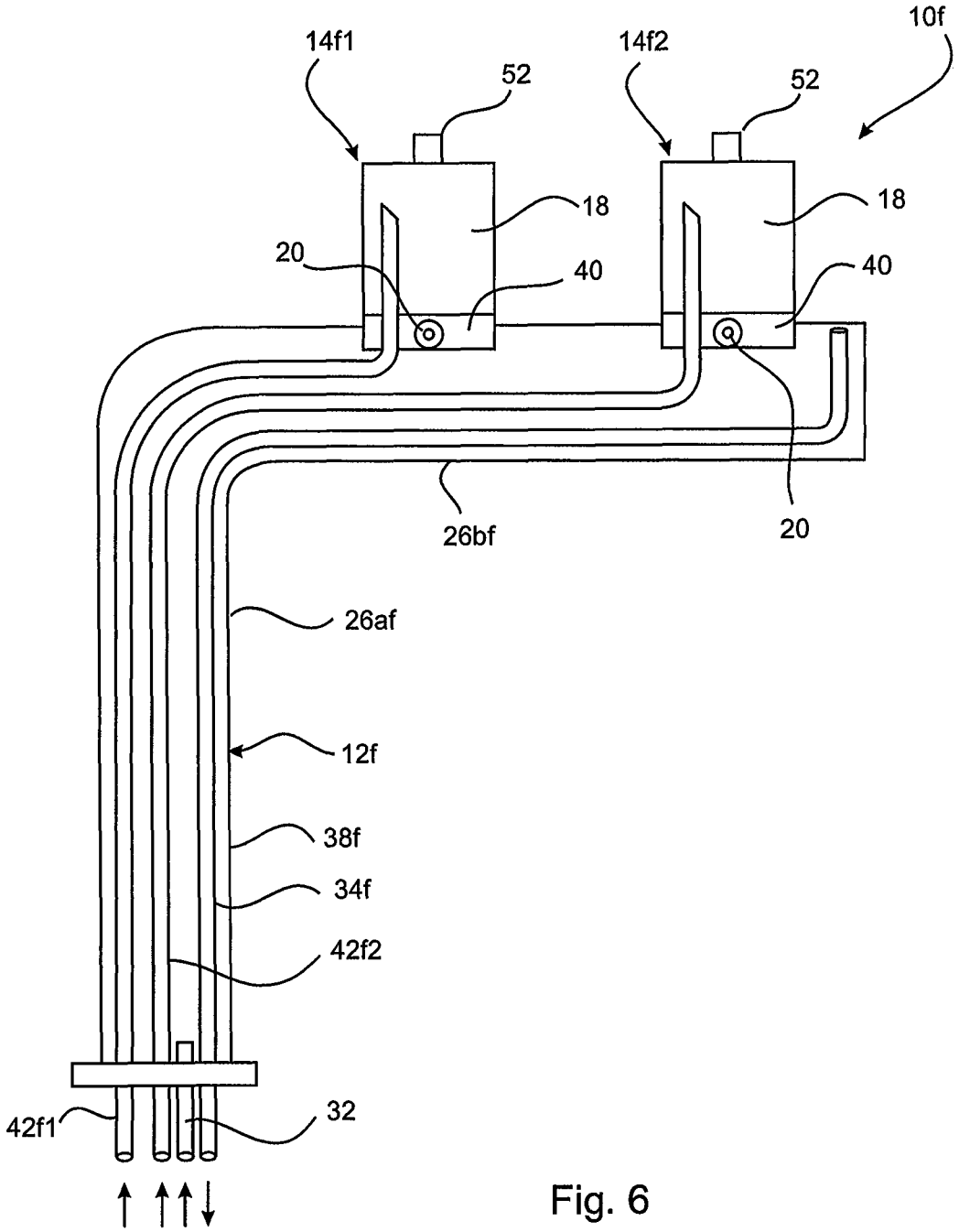
FIG. 6 is a schematic representation of a sixth embodiment of the beverage dispenser.

FIG. 6 depicts a beverage dispenser 10*f* which like the dispenser 10*e* has two separate beverage storage spaces designated as 14*f*1 and 14*f*2 respectively. However the beverage dispenser 10*f* is of substantially simpler construction. As a result, it is envisaged that the dispenser 10*f* would also be easier to dismantle, clean and maintain.

Looking at the dispenser 10*f* in more detail, it will be seen that this dispenser has a housing 12*f* in the general form of a tube which is bent through 90° having a generally vertically extending portion 26*af* and a contiguous horizontally extending cantilever portion 26*bf*. The two beverage storage spaces 14*f*1 and 14*f*2 are provided on the cantilever portion 26*bf*. Each of the beverage storage spaces 14*f*1 and 14*f*2 (herein after referred to in general as "spaces 14*f*") is provided with a wall 18 which is in the form of a tubular structure, and a wall 40 at one end of the tubular structure. The wall 40 in the dispenser 10*f* is of the same construction as that of the dispenser 10 shown in FIG. 1. Indeed the entire construction and configuration of each of the spaces 14*f* is the same as space 14 of the dispenser 10 shown in FIG. 1.

In order to supply beer to each of the spaces 14*f*1 and 14*f*2, two separate conduits 42*f*1 and 42*f*2 are provided, one of each extending through the respective wall 40 of a corresponding space 14*f*. Glycol is circulated through the housing 12*f* and corresponding tank 38*f* via glycol inlet pipe coupling 32 and outlet conduit 34*f*. In this embodiment tank is constituted by the combination of the vertically extending portion 26*af* and a contiguous horizontally extending cantilever portion 26*bf* of the housing 12*f*.

Dispensing taps/valves are not depicted in FIG. 6. However the coupling 20 is depicted. The coupling 20 enables connection to an adapter and a tap such as adapter 50 and tap 22 as shown in FIG. 1. Heat transfer and in particular cooling of the beer within the respective spaces 14*f*1 and 14*f*2 is accomplished by thermal conduction as the beer flows through the portions of conduits 42*f*1 and 42*f*2 within the tank 38*f*; and by thermal conduction across the respective walls 40.

Figure 7:
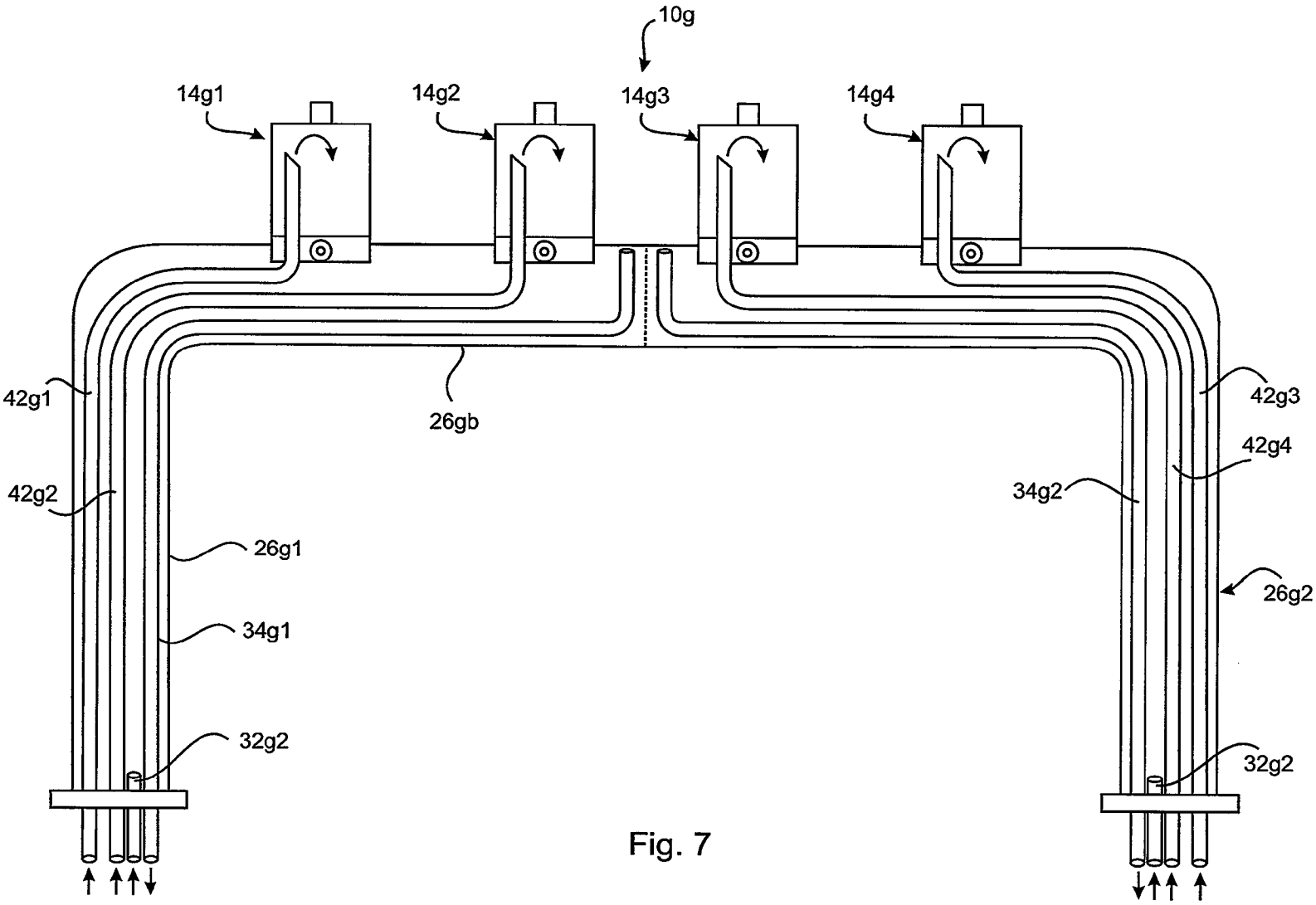
FIG. 7 is a schematic representation of a seventh embodiment of the beverage dispenser.

FIG. 7 depicts a further variation of the beverage dispenser denoted as 10*g*. The dispenser 10*g* is in effect two dispensers 10*f* "back to back" and joined as a single unit. As a consequence, the dispenser 10*g* is in the general configuration of a bridge font having two vertically extending cylindrical portions 26*g*1 and 26*g*2 and a horizontally extending intermediate portion 26*gb*. The dispenser 10*g* is provided with four identical dispensers 14*g*1-14*g*4 (hereinafter referred to in general as "spaces 14*g*"). Each dispenser 14*g* is of identical configuration to the dispensers 14 and 14*f* shown in FIGS. 1 and 6 respectively. The spaces 14*g* are supplied with beer via individual conduits 42*g*1-42*g*4 respectively. The dispenser 10*g* is provided with two separate heat exchanger fluid inlet couplings namely coupling 32*g*1 in the cylindrical portion 26*g*1 and coupling 32*g*2 in the cylindrical portion 26*g*2. Similarly, the dispenser 10*g* is provided with two heat exchanger return conduits namely conduit 34*g*1 that extends through the cylindrical portion 26*g*1 and conduit 34*g*1 that extends through the cylindrical portion 26*g*2.

In the dispenser 10*g*, the horizontal portion 26*gb* may be configured to enable complete flow through of heat exchanger fluid between cylindrical portions 26*g*1 and 26*g*2 or alternately may be formed with an internal barrier wall to fluidically isolate the cylindrical portions 26*g*1 and 26*g*2. The operation and functioning of the dispenser 10*g* is identical to that of the dispenser 10*f*.

Whilst a number of specific embodiments of the dispenser have been described, it should be appreciated that the dispenser may be embodied in many other forms. For example the beverage storage spaces described in relation to the dispensers 10*f* and 10*g* shown in FIGS. 6 and 7 may be replaced with beverage storage spaces 14 and corresponding walls 40 as depicted in any one of FIGS. 2-4. Also, the tubular structure constituting the wall 18 configured in a variety of cross sectional shapes including but not limited to circular, square or oval shaped. In addition the wall 18 does not need to be of a configuration or structure that is for its full circumference. For example, the wall 18 could be in the form of say a stainless steel cylinder with a plurality of windows enabling viewing into the interior of the space 14. Further the wall 18 may be formed of a material that has UV light filtering properties (i.e. is opaque to least a portion of the UV light spectrum) to prevent or minimize UV light from contacting the beverage inside the space/vessel 14. When the beverage is beer this acts to prevent or reduce the possibility of the beer being light struck. Light struck beer (also known as skunked beer) is beer in which isohumulones is decomposed by the light resulting in a tainting of its flavor. In addition the wall 18 need not necessarily be clear or 100% light transmissive. It may be translucent in the same way as a brown or green glass beer bottle.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the dispenser disclosed herein.

The invention claimed is:

1. A beverage dispenser comprising:

a tower having a base at a first end capable of being mounted on a bar, the tower having a tank adjacent the base, the tank capable of containing a circulating flow of a heat exchanger fluid; a beverage storage space capable of storing a volume of a beverage to be dispensed, the beverage storage space located at a second end of the tank opposite the base; and a common wall located at the second end of the tank, the common wall extending across the second end of the tank, and wherein the common wall fluidically separates the tank from the beverage storage space and is provided with an extension that extends into the beverage storage space, the common wall and the extension facilitating heat transfer between a circulating flow of heat exchanger fluid and the beverage within the beverage storage space;

a heat exchanger sub-system incorporating the tank and being operable to enable a flow of heat exchanger fluid into and out of the tank to facilitate the circulating flow of the heat exchanger fluid and effect the temperature of a beverage stored in or passing through the beverage storage space;

the beverage storage space provided with at least one wall through which beverage in the beverage storage space can be visualized; and an outlet enabling the coupling of a valve to facilitate dispensing of beverage from the beverage storage space.

2. The beverage dispenser according to claim 1 wherein the at least one wall is a wall in the configuration of a cylindrical tube.

3. The beverage dispenser according to claim 1 wherein the beverage storage space is disposed to enable direct contact by a heat exchanger fluid circulating through the heat exchanger sub-system.

4. The beverage dispenser according to claim 1 wherein the heat exchanger sub-system comprises one or more heat exchanger conduits enabling a heat exchanger fluid to flow into and out of the housing.

5. The beverage dispenser according to claim 4 wherein the one or more heat exchanger conduits are arranged to enable continuous circulation of heat exchanger fluid through the tank in a manner wherein the tank is continuously substantially filled with heat exchanger fluid.

6. The beverage dispenser according to claim 4 wherein the one or more heat exchanger conduits comprise a heat exchanger conduit that passes through the beverage dispensing space to enable heat exchange fluid to flow through the beverage storage space while being isolated from the contact with the beverage held or passing through the beverage storage space.

7. The beverage dispenser according to claim 1 comprising a beverage conduit arranged to enable beverage to flow into the beverage storage space and wherein the beverage conduit passes through the tank.

8. The beverage dispenser according to claim 1 wherein a channel is formed in the common wall through which beverage in the beverage storage space passes when being dispensed from the beverage dispenser, and wherein the outlet formed within a thickness of the common wall opens onto an outer surface of the common wall, the outlet being in fluid communication with the channel and capable of receiving a coupling for a beverage dispensing valve.

9. The beverage dispenser according to claim 1 wherein the beverage storage space is one of a plurality of beverage storage spaces and wherein the housing comprises at least one transparent wall for each of the beverage storage spaces; wherein the same or different beverages can be held and dispensed from respective beverage storage spaces.

10. The beverage dispenser according to claim 1 wherein the at least one wall through which beverage in the beverage storage space can be visualized is made from a transparent or translucent material.

11. The beverage dispenser according to claim 1 wherein the at least one wall through which beverage in the beverage storage space can be visualized is made of a UV light filtering material.

12. The beverage dispenser according to claim 2 wherein the cylindrical tube is open at opposite ends and wherein the common wall extends across and closes one end of the cylindrical tube adjacent the second end of the tank and further comprising a lid arranged to extend across and close an end of the cylindrical tube opposite the common wall.

13. The beverage dispenser according to claim 1 wherein the common wall has a substantially planar surface facing the tank.

14. The beverage dispenser according to claim 12 comprising a vent formed in the lid and in fluid communication with the beverage storage space, the vent being operable to enable bleeding of gas contained in the beverage storage space.

15. The beverage dispenser according to claim 2 wherein the cylindrical tube has substantially the same outer diameter as the tank at the second end of the tank.

16. A tower font comprising:

a tank having first and second opposite ends, the first end closed by a base capable of being mounted on a bar or counter, the tank capable of containing a circulating flow of a heat exchanger fluid;

a beverage storage space capable of storing a volume of a beverage to be dispensed, the beverage storage space located at the second end of the tank and arranged so that beverage in the beverage storage space can be visualized;

a common wall located at and extending across the second end of the tank wherein the common wall closes the second end of the tank and fluidically separates the tank from the beverage storage space, the common wall being provided with an outlet that has a channel that opens onto a recessed surface of the common wall in the beverage storage space, wherein the recessed surface faces the beverage storage space and wherein the channel extends through a thickness of the wall to open onto a further surface of the wall that faces a side wall of the tower, and wherein the outlet at the opening on the further wall is configured to enable coupling of a valve to facilitate dispensing of beverage from the beverage storage space; and a heat exchanger sub-system incorporating the tank and being operable to effect the temperature of a beverage stored in or passing through the beverage storage space.

17. The tower font according to claim 16 wherein the beverage storage space comprises a cylindrical tube.

18. The tower font according to claim 17 wherein one end of the cylindrical tube is closed by the common wall.

19. The tower font according to claim 17 comprising a lid wherein an end of the cylindrical tube distant the tank is closed by the lid.

20. The tower font according to claim 17 wherein the cylindrical tube has an outer diameter substantially the same as that of the tank at the second end of the tank.

21. The tower font according to claim 19 comprising a vent formed in the lid and in fluid communication with the beverage storage space, the vent being operable to enable bleeding of gas contained in the beverage storage space.

22. The beverage dispenser according to claim 16 wherein the common wall is provided with an extension that extends into the beverage storage space, and wherein the heat exchanger sub-system is arranged to facilitate a circulating flow of heat exchanger fluid through the tank and the extension and wherein the common wall and the extension facilitating heat transfer between the circulating flow of heat exchanger fluid and the beverage within the beverage storage space.

23. The beverage dispenser according to claim 1 wherein the extension is in the form of a tube closed by an upper wall at an end distant the common wall and opening at an opposite end into the tank to enable heat exchanger fluid to flow or reside within the extension, the extension configured so that beverage within the space is able to surround the extension.

24. The beverage dispenser according to claim 23 wherein the heat exchanger sub-system includes a heat exchanger fluid outlet conduit which enables heat exchanger fluid to subsequently flow out of the housing, the conduit having an open upper end that lies immediately adjacent the upper wall of the tube.

25. The beverage dispenser according to claim 23 wherein the common wall comprises an outer annular portion and the tube extends in an axial direction from a center of the annular portion.

26. The beverage dispenser according to claim 1 comprising a beverage conduit disposed in the tank wherein heat can be exchanged between the heat exchanger fluid within the tank and the beverage as the beverage flows through the beverage conduit prior to the beverage being dispensed through the beverage dispenser.

27. The beverage dispenser according to claim 1 comprising a vent in fluid communication with the beverage storage space and operable to enable bleeding of gas contained in the beverage storage space.

* * * * *